US005782346A

United States Patent [19]

Gray et al.

[11] Patent Number: 5,782,346

[45] Date of Patent: Jul. 21, 1998

[54] TRAY FOR A WET SHAVING RAZOR

[75] Inventors: Michael J. Gray, Duxbury; Gerald T. Swanson, Kingston, both of Mass.

[73] Assignee: The Gillette Company, Boston, Mass.

[21] Appl. No.: 803,155

[22] Filed: Feb. 19, 1997

[51] Int. Cl.[6] ..... B69D 65/00

[52] U.S. Cl. ..... 206/228; 206/775; 30/32

[58] Field of Search ..... 30/32, 40, 40.2, 30/50, 541; 206/208, 228, 349, 775, 776, 777; 211/70.7, 70.6; D9/342; D6/526; D28/44–47, 52–54

[56] References Cited

U.S. PATENT DOCUMENTS

| | | | |
|---|---|---|---|
| D. 159,807 | 8/1950 | Hanson . | |
| D. 216,635 | 2/1970 | Grange . | |
| D. 227,234 | 6/1973 | Glaberson . | |
| D. 256,995 | 9/1980 | Kiraly . | |
| D. 258,270 | 2/1981 | Gray . | |
| D. 313,175 | 12/1990 | Motta et al. . | |
| D. 320,342 | 10/1991 | Gray . | |
| D. 336,426 | 6/1993 | Fisher . | |
| D. 349,242 | 8/1994 | Lazarchik et al. . | |
| D. 352,236 | 11/1994 | Althaus . | |
| D. 364,060 | 11/1995 | Lai . | |
| D. 370,844 | 6/1996 | Shurtleff et al. . | |
| 2,432,818 | 12/1947 | Schults | 206/228 |
| 3,095,965 | 7/1963 | Stahl et al. | 206/228 |
| 3,366,268 | 1/1968 | Struck | 206/228 |
| 3,444,990 | 5/1969 | Braginetz | 206/228 |
| 3,754,326 | 8/1973 | Glaberson | 30/40 |
| 3,822,781 | 7/1974 | Braginetz . | |
| 4,373,628 | 2/1983 | Dantes . | |
| 5,113,586 | 5/1992 | Lazarchik et al. . | |
| 5,228,580 | 7/1993 | Grange . | |
| 5,319,852 | 6/1994 | Metzger | 30/541 |
| 5,407,066 | 4/1995 | Grange . | |
| 5,429,241 | 7/1995 | Althaus . | |
| 5,457,887 | 10/1995 | Grange . | |

FOREIGN PATENT DOCUMENTS

| | | |
|---|---|---|
| 605 880 A2 | 12/1993 | European Pat. Off. . |
| 80-04939 | 11/1980 | Netherlands . |

OTHER PUBLICATIONS

Sheet of photographs for Feather Razor Co. Razor Holder.

*Primary Examiner*—Maurina T. Rachuba
*Attorney, Agent, or Firm*—Fish & Richardson P.C.

[57] ABSTRACT

A tray for a razor that includes a base member and a platform member. The base member includes engagement structure for releasably holding the razor and platform support structure. The platform member is supported on the platform support structure, is secured to said base member, and is located behind at least part of a razor when the razor is held by the engagement structure.

35 Claims, 3 Drawing Sheets

TRAY FOR A WET SHAVING RAZOR

BACKGROUND OF THE INVENTION

The invention relates to a tray for a wet shaving razor.

It is known to provide a tray for supporting a wet shaving razor between uses and for presenting the razor in a desired manner in point-of-purchase sales packaging. Such trays typically include a base member that engages a razor handle to which a replaceable cartridge is connected. The base member often additionally holds a dispenser of replacement cartridges on the opposite side of the base member from the razor.

SUMMARY OF THE INVENTION

In one aspect, the invention features, in general, a tray for a razor that includes a base member and a platform member. The base member includes engagement structure for releasably holding the razor and includes platform support structure. The platform member is supported on the platform support structure, is secured to the base member, and is located behind at least part of a razor when the razor is held by the engagement structure.

Certain implementations of the invention may include one or more of the following features. In certain implementations, the platform member is behind the handle of the razor or the cartridge of the razor or both. The base member has an opening through it near the cartridge, and the platform member is transparent from the other side to permit viewing of the bottom side of the cartridge from the other side of the base member. The platform member is reflective over a portion aligned with a handle of the razor to reflect the bottom side of the handle. The portion of the platform member near the cartridge can be reflective from the top and transparent from the bottom over the majority of the surface; alternatively the edge of the portion of the platform member can be reflective from the top while the central portion is transparent.

In certain implementations, the platform member can have a contour that matches the contour along the length of the razor handle that is supported over the platform. The platform member is secured to the base member by snap-fitting engagement. The base member has a lip along the opening through the base member, the lip supporting an edge portion at the transparent portion of the platform member. The base member has recesses that receive tabs of the platform member. End portions of the platform member are retained under overlying portions of the base member, and a middle portion of the platform member is supported by portions of the base member underneath the platform member. The middle portion of the platform member is secured by snap-fit engagement to a projecting post structure that extends upward through an opening in the platform by nubs on the front of the projecting structure and overhanging portions of the projecting structure at the rear. The platform member has a drainage hole under the cartridge. The tray has structure for holding a dispenser of replaceable cartridges.

In another aspect, the invention features, in general, the combination of a razor and a tray as has already been described.

In another aspect, the invention features, in general, a tray for a wet shaving razor including a base, engagement structure carried on the base for releasably holding a razor, and a platform that is carried by the base, is located behind at least part of the region occupied by a razor when held by the engagement structure, and has a reflective surface that is concave so as to increase the extent of reflection of the razor by the reflective surface.

Implementations of the invention may have one or more of the following advantages. Having a platform member that is separate from and secured to a base member gives one flexibility in using different materials, different appearances, and different modes of manufacture for the base member and the platform member. The use of a transparent portion of the platform member that is aligned with a hole through the base member permits the bottom side of the cartridge to be displayed and viewed by customers prior to purchase. The use of a reflective portion of the platform member behind the handle permits the bottom of the handle to be viewed by customers prior to purchase by reflection. The reflective portion additionally provides for visual integration of the handle and the tray. The snap-fitting structure—recesses and mating tabs, overlying base member surfaces at the ends of the platform member, and front nubs and overhanging back portion at the post—and the supporting surfaces under the middle of the platform member all provide for ease of assembly.

Other advantages and features of the invention will be apparent from the following description of a preferred embodiment thereof and from the claims.

DESCRIPTION OF THE PREFERRED EMBODIMENT

Figure 1:
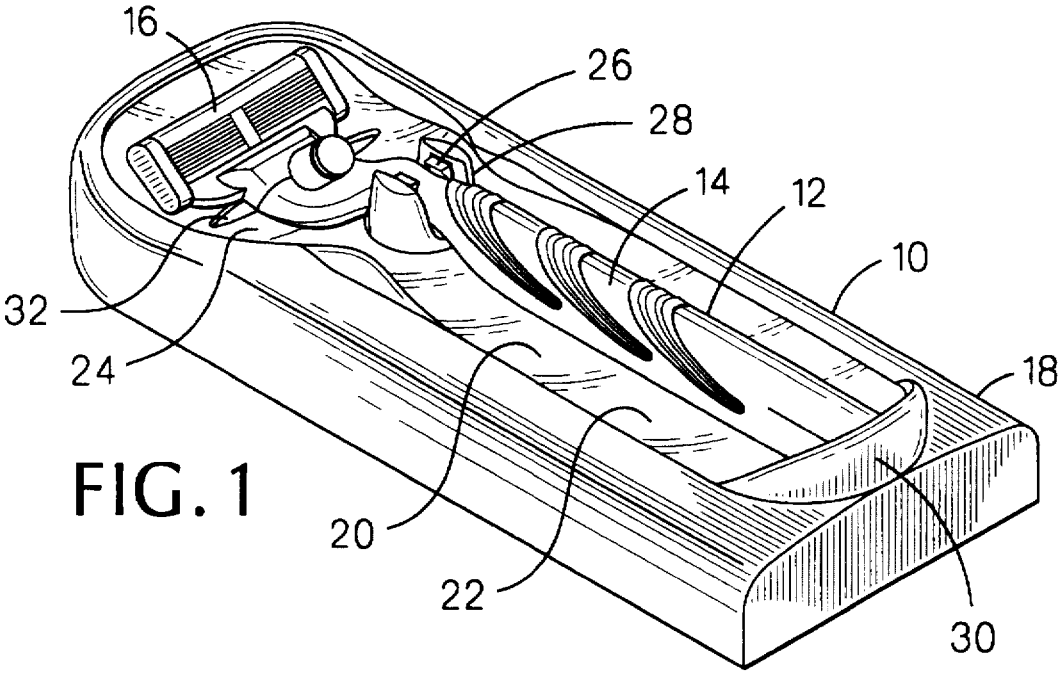
FIG. 1 is perspective view of a tray holding a wet shaving razor.

Referring to FIGS. 1–5, there is shown tray 10 holding wet shaving razor 12 therein. Razor 12 has elongated handle 14 and replaceable cartridge 16 at the end thereof. Tray 10 includes opaque base member 18 and reflective/transparent platform member 20 (FIG. 2) secured to base member 18 behind razor 12. Platform member 20 is shown attached to base member 18 in FIG. 1 and is shown apart from base member 18 in FIG. 2. Platform member 20 is secured to base member 18 by snap-fit engagement.

Base member 18 is made of molded medium impact polystyrene (MIPS) or high impact polystyrene (HIPS).

Platform member 20 is made of an optically clear plastic that can be metalized (e.g., polycarbonate). Platform member 20 is thermoformed or injection molded to the desired shape and is made reflective in reflective portion 22 underlying handle 14 by metalization. Transparent portion 24 of tray 10 underneath cartridge 16 is transparent from at least the bottom of tray 10 to permit viewing of the bottom side of cartridge 16 from the back side of tray 10 through hole 38 (FIGS. 2, 3) in base member 18.

Figure 4:
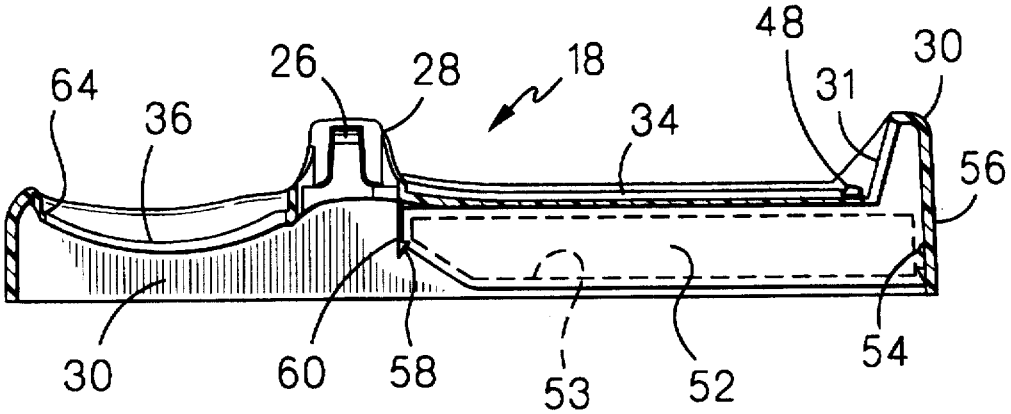
FIG. 4 is a sectional view, taken at 4—4 of FIG. 3, of the FIG. 3 base member.
Figure 5:
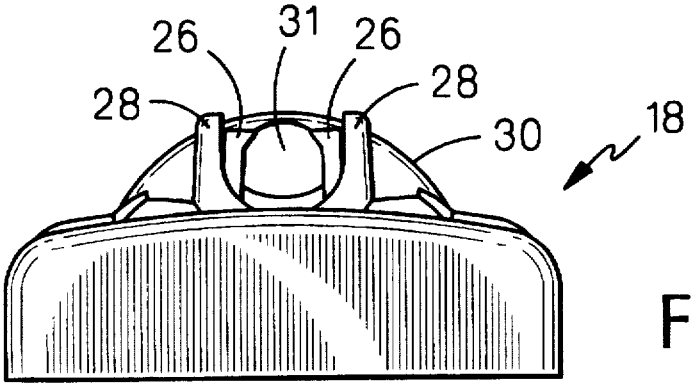
FIG. 5 is a front elevation of the FIG. 3 base member.

Razor 12 is held on base member 18 over platform member 20 by opposed resilient fingers 26 within projecting structure 28 (FIG. 5). Fingers 26 engage handle 14 near the cartridge end of handle 14. The bottom of handle 14 is retained in opening 31 (FIGS. 3–5) in hood 30 at an end of base member 18. Transparent portion 24 of platform member 20 is dished and has elongated drainage opening 32 (FIGS. 1, 2) to permit drainage of water that drips from cartridge 16 after use.

Figure 2:
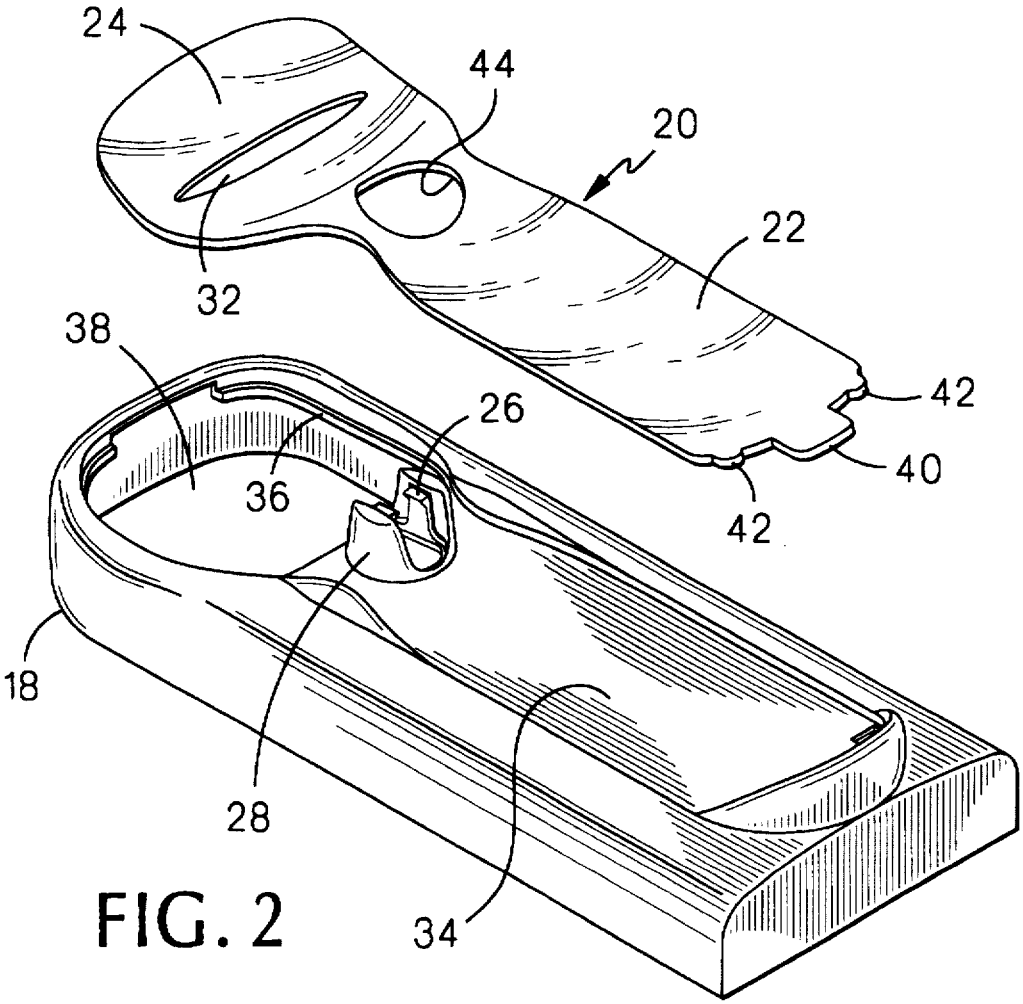
FIG. 2 is an exploded, perspective view showing a platform member and a base member of the FIG. 1 tray.
Figure 3:
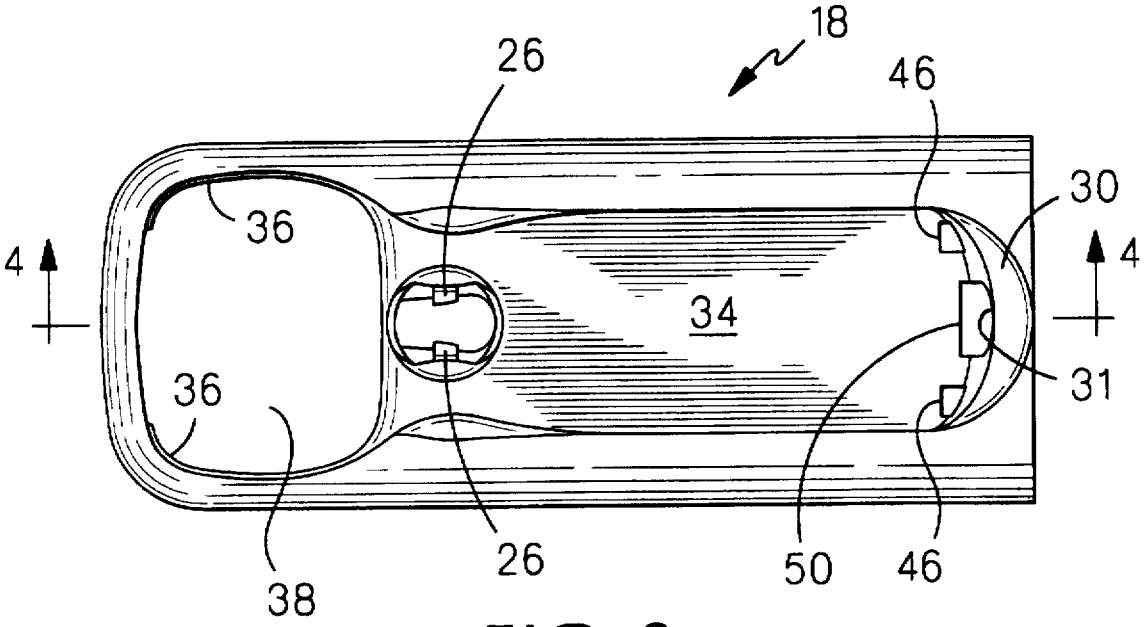
FIG. 3 is plan view of the base member of the FIG. 1 tray.
Figure 6:
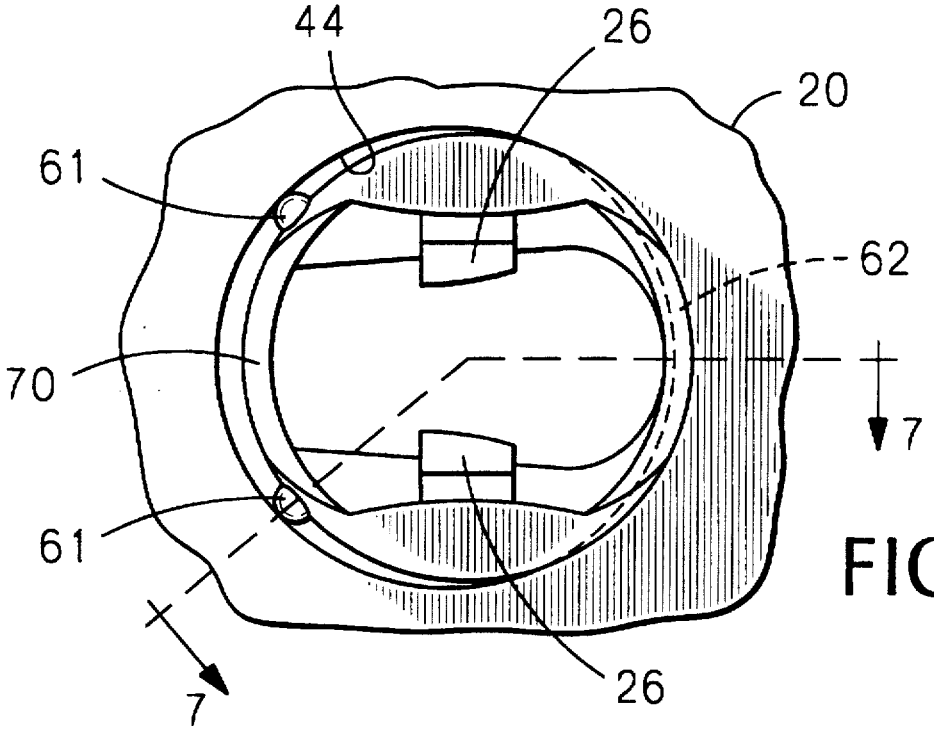
FIG. 6 is an enlarged partial plan view showing a projecting post structure of the FIG. 2 base member and the surrounding portion of the FIG. 2 platform member.
Figure 7:
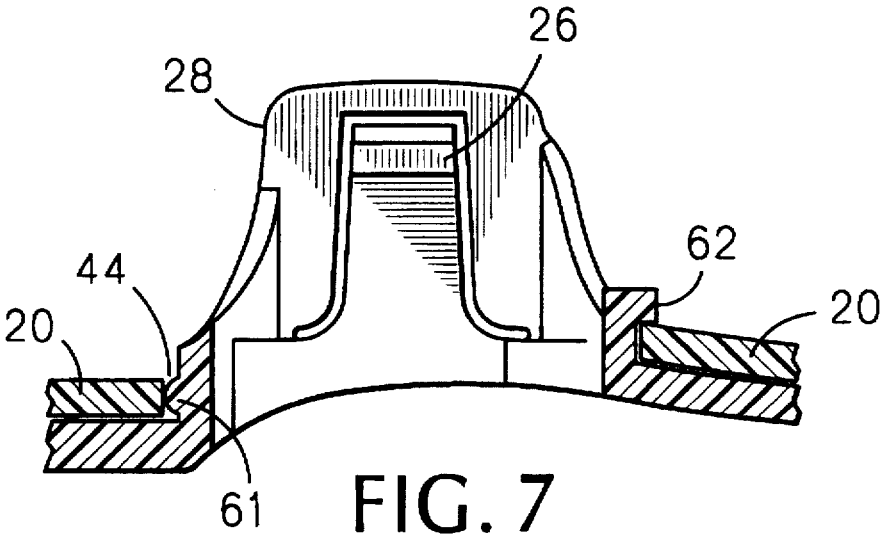
FIG. 7 is a partial vertical sectional view, taken at 7—7 of FIG. 6, showing structure providing snap-fit engagement of the FIG. 6 projecting post structure and the surrounding portion of the FIG. 2 platform member.

Referring to FIGS. 2 and 3, it is seen that platform member 20 is supported by surface 34 underneath reflective portion 22 and is also supported around hole 38 by lip 36 (FIGS. 2–4) along the sides and end of base member 18 underneath edge portions of transparent portion 24. Platform member 20 has locating tab 40 (which is not metallized) and optional retention tabs 42 at the bottom end thereof. Platform member 20 also has generally circular opening 44 through which projecting post structure 28 and resilient fingers 26 project. Referring to FIGS. 6 and 7, the middle portion of platform member 20 around opening 44 is secured by snap-fit engagement to projecting post structure 28 by two nubs 61 on the front of projecting post structure 28 and overhanging portion 62 of projecting structure 28 at the rear.

Referring to FIG. 3, surface 34 has two optional cutout regions 46 which are aligned with similar optional adjacent upward openings 48 (FIG. 4) in hood 30 to receive respective retention tabs 42 of platform member 20 (FIG. 2) if optional retention tabs 42 are used. Surface 34 also has a slight recessed region 50 leading to opening 31 in which tab 40 of platform member 20 (FIG. 2) sits.

Referring to FIG. 4, base member 18 also includes a region 52 underneath surface 34 for receiving dispenser 53 (shown in phantom in FIG. 4) containing a plurality of cartridges 16. Dispenser 53 is retained in region 52 via projections 54 on rear wall 56 of the base member and projections 58 on downwardly extending wall 60. The front edge of portion 24 of platform member 20 (FIG. 2) is retained under downwardly directed surface 64 of base member 18 (FIG. 4).

Figure 8:
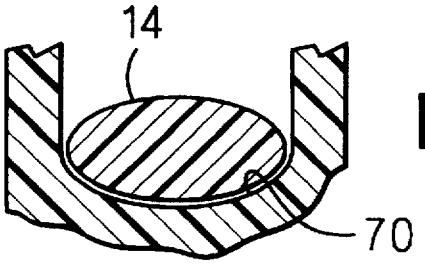
FIG. 8 is an enlarged, front partial elevation showing the handle cradled within the projecting post structure of the base member.

In preparation of point-of-purchase packaged products, platform member 20 is secured to base member 18 by inserting tabs 40, 42 in respective openings 31 and regions 46 and openings 48, fitting projecting structure 28, of base member 18 through opening 44, of platform member 20 and urging the front edge of platform member 20 under surface 64 (FIG. 4) to snap the front of platform member 20 into place and secure it to base member 18. Razor 12 is then placed on tray 10 by inserting the bottom of handle 14 into opening 31 and moving the other end of handle 14 downward, urging resilient fingers 26 apart until they snap back over the upper portion of handle 14. Front upwardly directed surface 70 at projecting post structure 28 has a curved, generally elliptically shape (FIG. 8) that matches that of the lower portion of handle 14 that rests on it to cradle handle 14 and help hold it in proper position.

Dispenser 53 (containing replacement cartridges) is then inserted into the bottom of tray 10 and is engaged by projections 54 and 58. The combination of tray 10, razor 12, and dispenser 53 is then secured to point-of-purchase packaging (e.g., a blister pack) in a manner that permits the customer to see both the upper surface of tray 10, with razor 12 thereon, and the lower surface of transparent portion 24 of platform member 20 through hole 38. The customer can thus see the details of the downwardly-directed blades, guard and cap of cartridge 16 through the transparent portion. The bottom of handle 14 is also visible by reflection from reflective portion 22. Alternatively, the front portion of platform member 20 (under cartridge 16) could be selectively reflective (i.e., reflective from top and transparent from bottom) over its entire surface. Another alternative is that the front portion of platform member 20 (under cartridge 16) could be reflective at an edge portion and transparent at a central portion. Platform member 20 is concave in two dimensions (i.e., along a longitudinal axis aligned with handle 14 and along a perpendicular axis) which allows a wider viewing angle and increases the extent of reflection of handle 14 and also of cartridge 16 when at least a portion of platform member 20 near cartridge 16 is reflective. Handle 14 has a contour along its length, and platform member 20 has a matching contour to provide for visual integration of handle 14 with tray 10.

After purchase, a shaver can store razor 12 on tray 10 between uses and can remove razor 12 with one hand, by releasing handle 14 from fingers 26 and moving it forward so as to remove the rear end of handle 14 from opening 31 of hood 30. Drainage hole 32 permits drainage of water dripping from cartridge 16.

Other embodiments of the invention are within the scope of the appended claims. For example, platform member 20 can be secured to base member 18 by other techniques.

What is claimed is:

1. A tray for a wet shaving razor comprising, a base member including engagement structure for releasably holding a said razor on said base member, said base member including platform support structure, and a platform member that is supported on said platform support structure, is secured to said base member, and is located behind at least part of the region occupied by a said razor when held by said engagement structure, wherein said shaving razor includes a cartridge and a handle, wherein said platform member has a cartridge portion located behind the region occupied by said cartridge when said razor is held by said engagement structure, wherein said base member has an opening through it in the region under said cartridge portion, and wherein said cartridge portion of said platform member is transparent from a surface that is opposite from a surface facing said cartridge when said razor is held on said tray to permit viewing of the side of said cartridge facing said platform member.

2. The tray of claim 1 wherein said platform member includes a handle portion located behind the region occupied by said handle when said razor is held by said engagement structure.

3. The tray of claim 2 wherein said platform member has a hole through which said engagement structure projects.

4. The tray of claim 2 wherein said platform member is reflective over said handle portion, whereby the bottom of a said handle will be reflected by said handle portion.

5. The tray of claim 4 wherein said handle portion is concave so as to increase the extent of reflection of said handle by said handle portion.

6. The tray of claim 1 wherein said platform member is secured to said base member by snap-fitting engagement.

7. The tray of claim 6 wherein said base member has recesses for receiving tabs of said platform member, and said platform member has tabs received in said recesses in said base member.

8. The tray of claim 1 wherein said support structure includes a lip along said opening that supports an edge portion of said platform member.

9. The tray of claim 1 wherein said platform member has first and second end portions retained under overlying portions of said base member and is supported by portions of said base member underneath said platform member between said first and second end portions.

10. The tray of claim 1 wherein said platform member includes a middle portion with an opening, and said base member includes a projecting post structure that extends upward through said opening, and wherein said middle portion is secured by snap-fit engagement to said projecting post structure by nubs on the front of the projecting structure that engage edge portions of said platform member around said opening and by overhanging portions at the rear of said projecting post structure.

11. The tray of claim 1 wherein said platform member has a dished portion with a drainage hole near the region occupied by said cartridge when said razor is held by said engagement structure.

12. The tray of claim 1 wherein said base member further comprises structure for holding a dispenser of replaceable cartridges.

13. The tray of claim 1 wherein said cartridge portion is reflective from the majority of said surface facing said cartridge, and is transparent from the majority of said surface that is opposite from said surface facing said cartridge.

14. The tray of claim 1 wherein said cartridge portion is reflective from an edge portion of said surface facing said cartridge, and is transparent from at central portion of said surface that is opposite from said surface facing said cartridge.

15. The tray of claim 13 or 14 wherein said cartridge portion is concave so as to increase the extent of reflection of said cartridge by said cartridge portion.

16. The tray of claim 1 wherein said base member and said platform member are separate structures.

17. The combination comprising a wet shaving razor, a base member including engagement structure releasably holding said razor on said base member, said base member including platform support structure, and a platform member that is supported on said platform support structure, is secured to said base member, and is located behind at least part of said razor when held by said engagement structure, wherein said base member and said platform member are separate structures.

18. The combination of claim 17 wherein said razor includes a elongated handle having a length and a handle contour along said length, and wherein said platform member has a platform contour that matches said handle contour.

19. The combination of claim 17 wherein said razor includes a cartridge and a handle, and wherein said platform member has a first portion located behind said handle when said razor is held by said engagement structure.

20. The combination of claim 17 wherein said shaving razor includes a cartridge and a handle, and wherein said platform member has a second portion located behind said cartridge when said razor is held by said engagement structure.

21. The combination of claim 20 wherein said base member has an opening through it in the region under said second portion, wherein said second portion of said platform member is transparent from a surface that is opposite from a surface facing said cartridge when said razor is held on said tray to permit viewing of the side of said cartridge facing said platform member.

22. The combination of claim 21 wherein said support structure includes a lip along said opening that supports an edge portion of said platform member.

23. The combination of claim 21 wherein said platform member has a dished portion with a drainage hole near the region occupied by said cartridge when said razor is held by said engagement structure.

24. The combination of claim 17 wherein said platform member is secured to said base member by snap-fitting engagement, and wherein said base member has recesses for receiving tabs of said platform member, and said platform member has tabs received in said recesses in said base member.

25. The combination of claim 17 wherein said platform member has first and second end portions retained under overlying portions of said base member and is supported by portions of said base member underneath said platform member between said first and second end portions.

26. The combination of claim 17 wherein said base member further comprises holding structure for holding a dispenser of replaceable cartridges, and further comprising said dispenser being held by said holding structure.

27. The combination comprising a wet shaving razor, a base member including engagement structure releasably holding said razor on said base member, said base member including platform support structure, and a platform member that is supported on said platform support structure, is secured to said base member, and is located behind at least part of said razor when held by said engagement structure, wherein said shaving razor includes a cartridge and a handle, and wherein said platform member includes a first portion located behind said handle when said razor is held by said engagement structure and a second portion located behind said cartridge when said razor is held by said engagement structure, wherein said base member has an opening through it in the region under said second portion, wherein said second portion of said platform member is transparent from a surface that is opposite from a surface facing said cartridge when said razor is held on said tray to permit viewing of the side of said cartridge facing said platform member, wherein said platform member is reflective over said first portion.

28. The combination of claim 27 wherein said first portion is concave so as to increase the extent of reflection of said handle by said first portion.

29. The combination of claim 28 wherein said second portion is reflective from an edge portion of said surface facing said cartridge, and is transparent from a central portion of said surface that is opposite from said surface facing said cartridge.

30. The tray of claim 29 wherein said second portion is concave so as to increase the extent of reflection of said cartridge by said second portion.

31. The combination of claim 27 wherein said platform member has a hole through which said engagement structure projects.

32. A tray for a wet shaving razor including a cartridge and a handle comprising, a base, engagement structure carried on said base for releasably holding a said razor, and a platform that is carried by said base and is located behind at least part of the region occupied by a said razor when held by said engagement structure, said platform having a reflective surface that is concave so as to increase the extent of reflection of said razor by said reflective surface wherein said platform has a first concave portion located behind the region occupied by said handle when said razor is held by said engagement structure.

33. The tray of claim 32 wherein said handle is elongated and has a length and a handle contour along said length, and wherein said platform has a platform contour that matches said handle contour.

34. The tray of claim 32 wherein said platform has a second concave portion located behind the region occupied by said cartridge when said razor is held by said engagement structure.

35. A tray for a wet shaving razor comprising, a base member including engagement structure for releasably holding a said razor on said base member, said base member including platform support structure, and a platform member that is supported on said platform support structure, is secured to said base member, and is located behind at least part of the region occupied by a said razor then held by said engagement structure, wherein said base member and said platform member are separate structures.

* * * * *